US005145443A

United States Patent [19]

Vaisnys et al.

[11] Patent Number: 5,145,443

[45] Date of Patent: Sep. 8, 1992

[54] MUSICAL TOY HOOP

[75] Inventors: Gintaras A. Vaisnys; Philip C. Black, both of North Haven; Barry Y. Piels, Fairfield; Robert S. McDarren, Ridgefield, all of Conn.

[73] Assignees: Cygnet, Inc., Woodbridge; Link Group International, Ridgefield, both of Conn.

[21] Appl. No.: 740,951

[22] Filed: Aug. 6, 1991

[51] Int. Cl.[5] ..... A63H 1/24; A63H 5/00; A63H 1/28

[52] U.S. Cl. ..... 446/242; 446/265; 446/409

[58] Field of Search ..... 446/236, 242, 213, 215, 446/252, 265, 409

[56] References Cited

U.S. PATENT DOCUMENTS

| | | | |
|---|---|---|---|
| 708,143 | 9/1902 | Ainman | 446/409 |
| 1,259,889 | 3/1918 | MacDonald | 446/409 |
| 1,535,144 | 4/1925 | Aptowicz | 446/409 |
| 2,946,152 | 7/1960 | Rubin | 446/265 |
| 3,079,728 | 3/1963 | Melin | 446/236 |
| 3,911,264 | 10/1975 | Chao | 446/439 |
| 4,006,556 | 2/1977 | Williams | 446/242 |
| 4,058,314 | 11/1977 | Wolf | 446/265 X |
| 4,100,697 | 7/1978 | Ward | 446/236 X |
| 4,568,303 | 2/1986 | Brown | 446/242 |
| 4,915,666 | 4/1990 | Maleyko | 446/439 X |
| 4,946,416 | 8/1990 | Stern et al. | 446/409 |
| 4,964,837 | 10/1990 | Collier | 446/219 X |
| 5,083,964 | 1/1992 | Arad et al. | 446/236 |

FOREIGN PATENT DOCUMENTS

| | | | |
|---|---|---|---|
| 1215865 | 4/1902 | France | 446/236 |
| 9013337 | 11/1990 | PCT Int'l Appl. | 446/236 |

*Primary Examiner*—Robert A. Hafer
*Assistant Examiner*—D. Neal Muir
*Attorney, Agent, or Firm*—Maurice M. Klee

[57] ABSTRACT

A hoop type toy is provided having a sound generating system for generating a tone, a steady simple beat, a rhythmic beat, or a tune. In certain embodiments, sound generation only occurs when the hoop is in motion. In other embodiments, the rate, pitch, speed, and/or loudness of the tone, beat or tune varies with the rate of rotation of the hoop. In the preferred embodiments, the sound generating system includes a speaker and a circuit board having an IC chip and integral motion detector. In this way, ruggedness, low cost, and small size are achieved.

7 Claims, 3 Drawing Sheets

MUSICAL TOY HOOP

BACKGROUND OF THE INVENTION

1. Field of the Invention

This invention relates to roy hoops and, in particular, to a toy hoop which produces sounds during use.

2. Description of the Prior Art

Toy hoops which the user rotates about a part of his or her body, e.g., his or her waist, have been known for many years. Such hoops are commonly known as "hula hoops". Although hula hoops enjoyed great success in the 1950's and 1960's, in recent years, the public has had only moderate interest in this type of toy.

Over the years, various patents have issued directed at improving the characteristics of the hula hoop. For example, Melin, U.S. Pat. No. 3,079,728, discloses adding ribs or grooves to the inside surface of the hula hoop to increase the friction between the hoop and the user. Similarly, Williams, U.S. Pat. No. 4,006,556, discloses placing a series of light bulbs inside the hoop. See also, Chao, U.S. Pat. No. 3,911,264.

Although the idea of adding lights to a hula hoop theoretically could increase interest in this type of toy, it is significant to note that the user can only somewhat see the lights in use. Typically, the user keeps his or her eyes facing forward when playing with a hula hoop. In this position, the lights proposed by Williams can only be seen at the periphery of the user's vision. As a result, to the present inventors' knowledge, the lighted hula hoop has not been commercially accepted.

SUMMARY OF THE INVENTION

In view of the foregoing state of the art, there is a need for an improved hula hoop which will increase the user's interest and enjoyment in playing with this type of toy. More particularly, there is a need for an improved hula hoop which will interact more effectively with the user's senses during play.

To address this need, the present invention provides a hoop-type toy which in its broadest aspects emits sound as it is used. Significantly, in comparison with the light emitting hula hoops, the user can perceive the sound irrespective of the orientation in which the user holds his or her head. This is an important advantage of the invention in providing a new and renewed level of interest for this basic childhood toy.

In connection with certain of its specific aspects, the improved hoop toy of the invention can emit sound consisting of a steady beat, a rhythmical beat, or a complete musical tune. The rate, pitch, and/or loudness of the beat or tune can be constant, or it can be set by the user, or it can change with the rate of rotation of the hoop. Alternatively, the hoop toy can emit a steady tone. Again, the pitch and/or loudness of the tone can be constant, or can be set by the user, or can change with the rate of rotation of the hoop.

In certain of its embodiments, the user can have the hoop emit its sound continuously. In other embodiments, the sound is only emitted when the hoop is in motion. In connection with these embodiments, the hoop can emit a complete series of sounds upon motion activation or can only emit sounds while in motion.

In the preferred embodiments of the invention, the sound is generated by a miniature speaker and an integrated circuit, which together have a small size and weight so as not to adversely affect the balance of the hoop while in use. In addition, these components require minimal electrical power so that the power source for the sound generator can also be miniaturized.

The accompanying drawings, which are incorporated in and constitute part of the specification, illustrate the preferred embodiments of the invention, and together with the description, serve to explain the principles of the invention. It is to be understood, of course, that both the drawings and the description are explanatory only and âre not restrictive of the invention.

DESCRIPTION OF THE PREFERRED EMBODIMENTS

Figure 1:
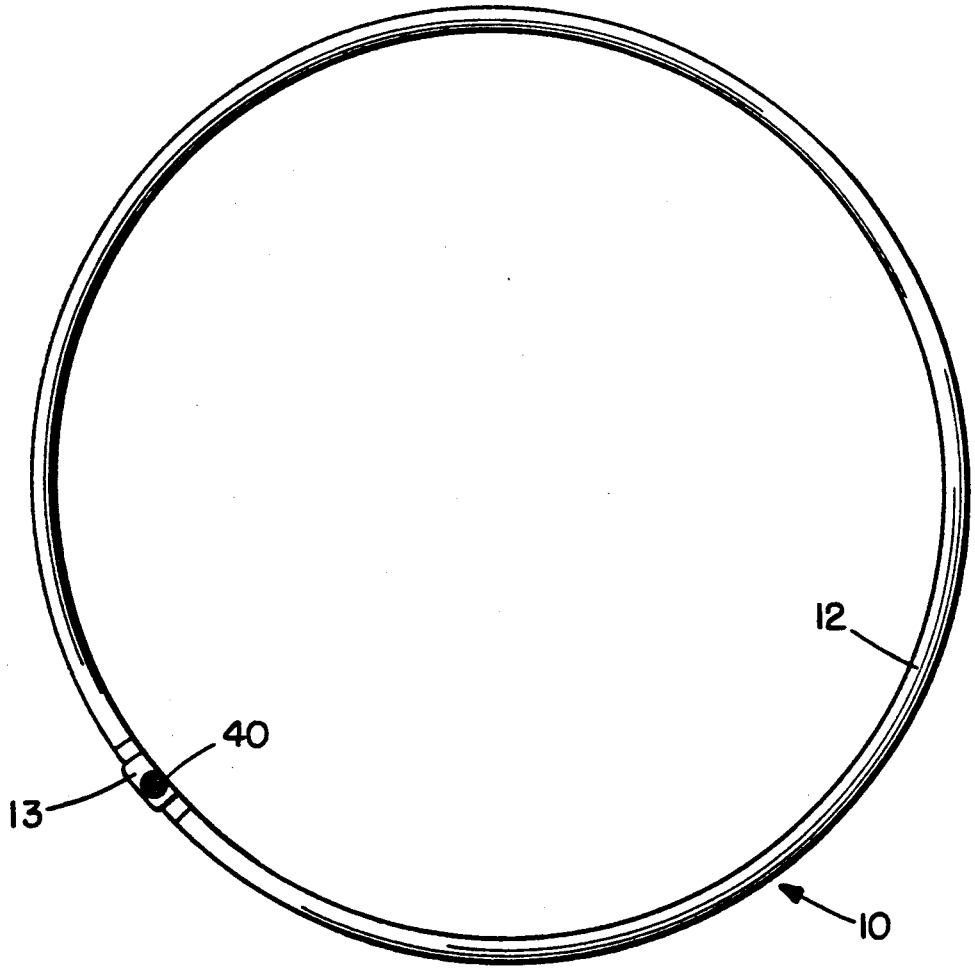
FIG. 1 is a top view of a hoop toy constructed in accordance with the present invention.

With reference now to the drawings, wherein like reference characters designate like or corresponding parts throughout the several views, there is shown in FIG. 1 a hoop toy 10 constructed in accordance with the present invention.

Hoop toy 10 includes hollow tube 12 which is composed of a conventional extrudable plastic material. Tube 12 typically will have an inside diameter of about 11/16 inches and a wall thickness of about 1/16 inches. If the hoop toy is to be used as a hula hoop intended for rotation about the user's waist, the overall diameter of the toy will be in the range of from about 30 inches to about 36 inches. The invention can also be practiced for hoop toys intended to be rotated around the neck, feet, or arms. In these cases, the overall diameter of the toy will be smaller, e.g., on the order of 16 inches.

As shown in FIG. 1, the ends of hollow tube 12 are joined together by plug 13. Plug 13 includes end portions 22 and 24 (see FIG. 2) which have an outside diameter substantially equal to the inside diameter of tube 12 and thus form a tight press fit between the plug and hollow tube 12. If desired, staples or other fastening means (not shown) can be used to further ensure that ends of tube 12 will not pull away from plug 13 during use.

Plug 13 carries the four basic elements of the sound generating system: a) speaker 14, b) signal generating means 16, c) power source 18, and d) switch 20. The plug is composed of two mating sections 26 and 28. Plug 13 includes housing portion 30 which contains speaker 14, circuit board 32, and battery contacts 34 and 36 for engaging power source 18, e.g., two AAA batteries. Housing portion 30 includes openings 40 for allowing the sound to radiate from the hoop. Bottom section 28 mates with the upper section 26 to hold the batteries, as well as the speaker and circuit board, firmly in place during use. Screws 38 are used to connect the two sections together. Bottom section 28 can include a removable panel (not shown) for replacing batteries 18. Also, the bottom section can include a slot (not shown) for inserting a removable insulator (not shown) between batteries 18 to prevent operation of the sound generating system during shipping of the product to the consumer.

Figure 2:
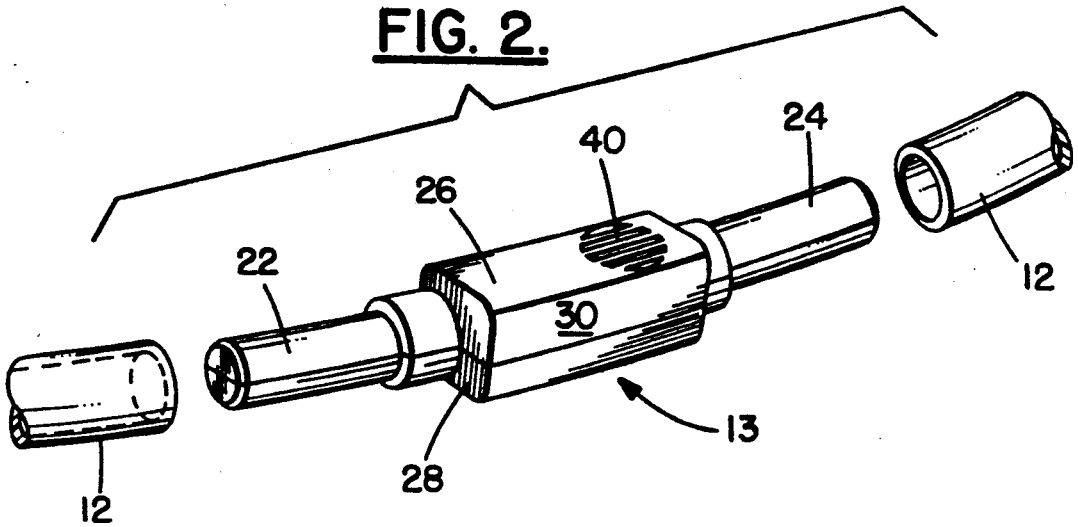
FIG. 2 is a perspective view of the housing assembly for the sound generating system of the invention.
Figure 3:
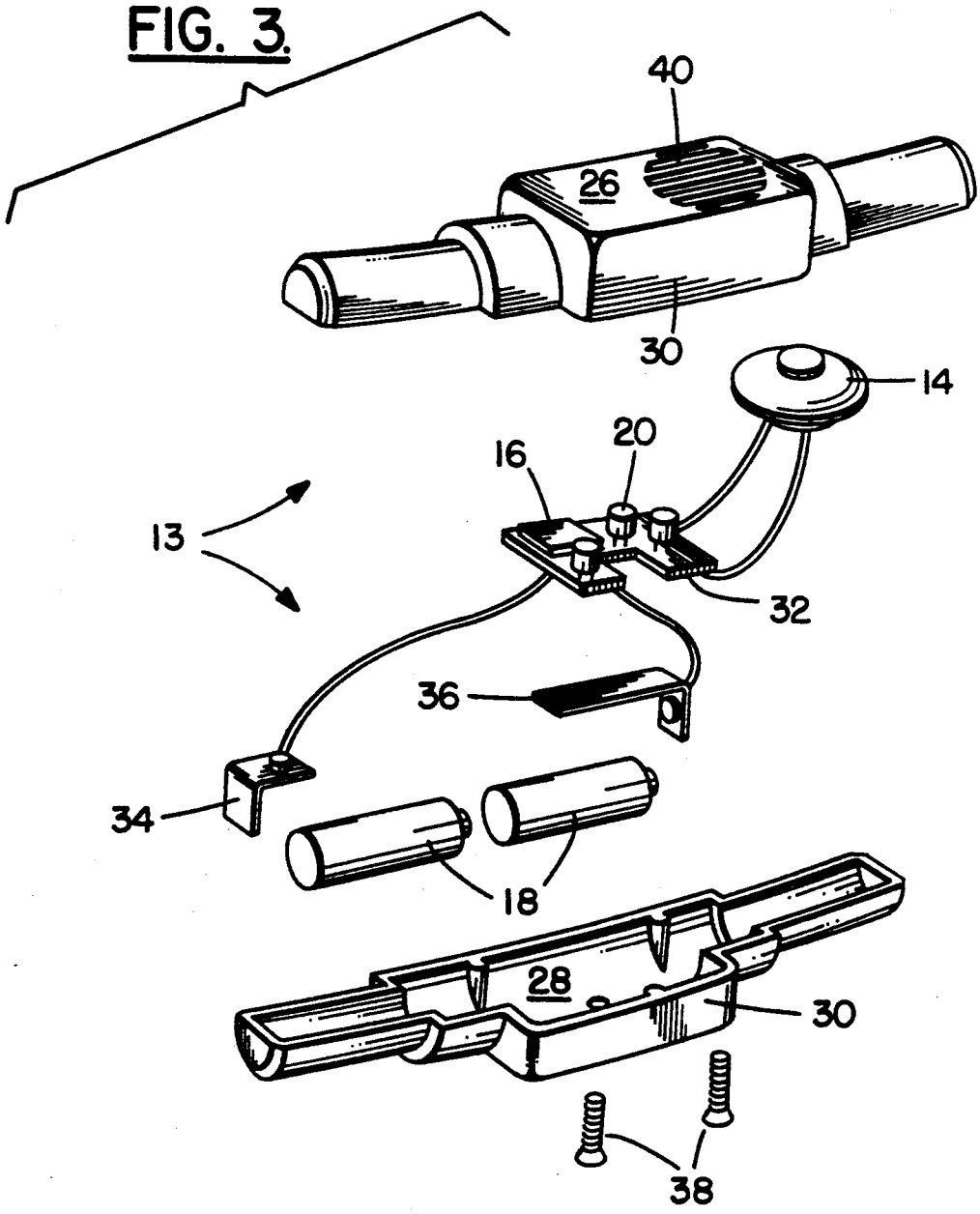
FIG. 3 is an exploded view of the housing assembly of FIG. 2 and the sound generating system contained therein.

As shown in FIGS. 1-3, housing portion 30 is flush with the inner diameter of the hoop but extends beyond the outer diameter. In this way, somewhat larger components can be used for the sound generating system without interfering with the rotation of the hoop around the user's body. If desired, all the components can be housed in a plug which is completely flush with the surface of hollow tube 12.

Various types of speakers 14 can be used in the practice of the invention, including moving coil and piezoelectric speakers. Similarly, various signal generating circuits can be used to produce the desired tone, beat or tune. The preferred signal generator is a solid state, single chip, integrated circuit containing the logic and required memory to produce the tone, beat or tune. Such chips are commercially available from such manufacturers as SMOS Systems, Inc., San Jose, Calif., e.g., catalog numbers SVM7902 and SVM7903. The chip can be of the type that plays for a predetermined time once triggered, or one that requires a continuing trigger signal to operate.

Switch 20 can also take various forms. In its preferred embodiment, the switch constitutes a motion detector and thus the sound generating system only operates when the hoop is being used. Alternatively or in combination with a motion detector switch, the apparatus can include a user activated switch on, for example, the outer surface of housing portion 30 which will allow the user to have the sound generating system continuously generate sound.

Various motion detecting switches can be used. For example, the switch can be of the weight-on-a-beam type or of the coil-spring-about-a-central-conductor type. In either case, the switch is preferably built as part of circuit board 32. For example, the weight-on-a-beam type switch can be constructed by riveting one end of a bent piece of metal to the board and attaching a weight to the other end. As the hoop is spun, the centrifugal force of the weight bends the metal until it touches a contact on the circuit board. Similarly, the coil spring type switch can be constructed by connecting the central conductor and one end of the spring to the board. As the board experiences acceleration, the free end of the spring contacts the central conductor thus closing the switch.

As mentioned above, the rate or other characteristics of the sound produced by the sound generating system can be (a) constant, (b) user adjustable, or (c) can vary with the rate of rotation of the hoop. In the latter two cases, a sound generating chip having an input pin for varying the rate or other characteristic of the sound generated is used. In the case of a user adjustable sound, a variable resistor, which can be set by means of a screw or knob, can be included in housing 30. By adjusting this resistor, the user can, for example, increase or decrease the rate at which the chip generates a beat or tune.

Sound generation which varies with the rate of rotation of the hoop is obtained as follows. During each rotation, plug 13 passes through a zone of minimum acceleration in the region of the user's body and a zone of maximum acceleration at the extreme position from the user's body. Switch 20 is selected so that it is closed in the zone of maximum acceleration and is open in the zone of minimum acceleration. The output of this switch is used to generate an input for the sound adjusting pin of the sound generation chip. For example, the closing of the switch can be used to charge or discharge a capacitor, and the voltage across the capacitor can be applied to the sound adjusting pin. Alternatively, a digital counter, either internal to the sound generation chip or as a separate chip, can be used to produce a signal which varies monotonically with the rate of opening or closing of switch 20.

Figure 4:
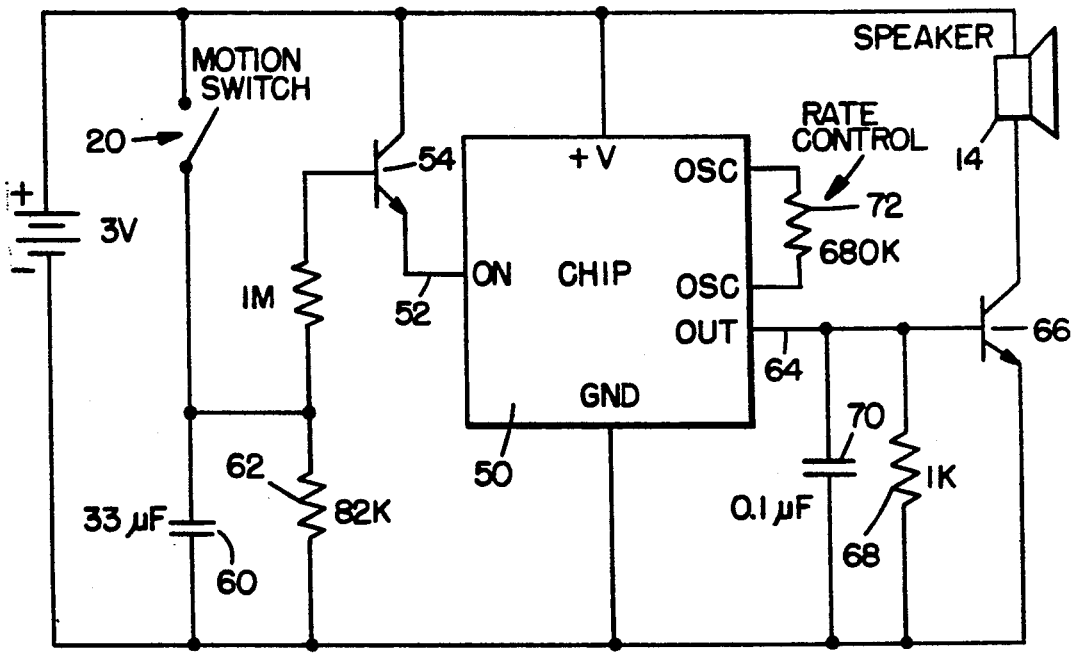
FIG. 4 is a schematic of a circuit for generating sound in response to motion of the hoop.

A suitable circuit for use with the present invention is shown in FIG. 4. Chip 50 generates a rhythmic sequence when a signal is present on lead 52, the rate at which the sequence is generated being determined by the resistance of resistor 72. Lead 52 is connected to transistor 54 whose base is under the control of switch 20, which can comprise a central fixed conductor surrounded by a moveable wire coil.

When switch 20 closes, capacitor 60 charges to the battery voltage which turns on transistor 54. Resistor 62 slowly discharges capacitor 60 when switch 20 opens. Capacitor 60 and resistor 62 are chosen so that transistor 54 remains on for the expected period of rotation of the hoop so that continuous rotation results in continuous sound.

The output of chip 50 appears on pin 64 which is connected to the base of drive transistor 66 which is in series with speaker 14. The parallel combination of resistor 68 and capacitor 70 serves to condition the output waveform from chip 50 to produce a more pleasing sound.

Figure 5:
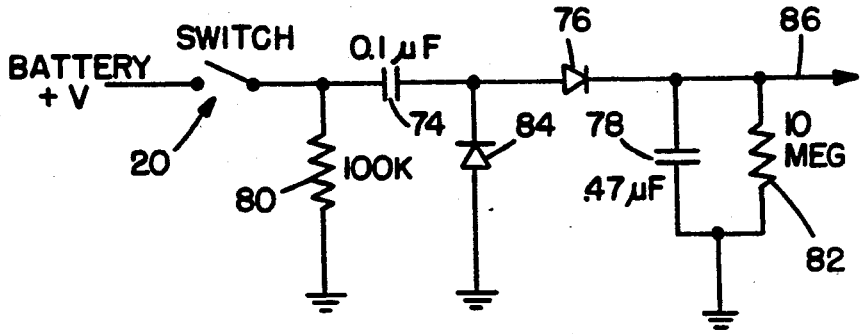
FIG. 5 is a schematic of a circuit for generating an analog voltage proportional to the rate of rotation of the hoop.

A circuit which can be used to generate an analog voltage proportional to the rate of rotation of the hoop is shown in FIG. 5. In general terms, the circuit is of the "charge pump" type.

Closing of switch 20 charges capacitors 74 and 78. The voltage developed across each of the capacitors is a function of its relative capacitance, with the larger capacitor 78 developing less voltage than the smaller capacitor 74. For the capacitance values given in the figure, capacitor 78 develops about 1/6 of the battery voltage on the initial switch closure and capacitor 74 develops about 5/6 of the battery voltage.

When switch 20 opens, capacitor 74 discharges through resistor 80, with current being supplied by diode 84. Resistor 80 is chosen so that the rate of discharge of capacitor 74 is fast relative to the expected closure rate of switch 20. In this way, capacitor 74 can essentially completely discharge each time switch 20 is opened.

At the same time that capacitor 74 is discharging, capacitor 78 is also discharging through resistor 82, but not through resistor 80 because of diode 76. Resistor 82 is chosen so that the rate of discharge of capacitor 78 is slow relative to both the expected switch closure rate and the rate of discharge of capacitor 74. Accordingly, when switch 20 recloses, capacitor 78 will still have a substantial portion of its prior charge.

The reclosing of switch 20 pumps charge into uncharged capacitor 74. This charge is shared with capacitor 78, which causes its voltage to rise. As the closing-/opening of switch 20 continues, the voltage on output lead 86 varies as a semi-linear function of the rate of closure. This output voltage, in turn, can be fed to a sound generating chip to produce sounds which vary with the rate of rotation of the hoop.

Although specific embodiments of the invention have been described and illustrated, it is to be understood that modifications can be made without departing from the invention's spirit and scope. For example, electronic components and circuit strategies other than those discussed above can be used in the practice of the invention. Also, although a single plug has been illustrated, multiple plugs can be used to generate one or more than one tone, tune and/or beat. A variety of other modifications which do not depart from the scope and spirit of the invention will be evident to persons of ordinary skill in the art from the disclosure herein. The following claims are intended to cover the specific embodiments set forth herein as well as such modifications, variations, and equivalents.

What is claimed is:

1. A sound emitting hoop toy comprising:

(a) a hollow tube having first and second ends;

(b) a plug for engagement with the first and second ends to form a closed loop having a substantially continuous inner periphery, said plug (i) including openings to allow sound to radiate from the plug and (ii) comprising two mating sections which form an internal cavity; and (c) sound generating means carried by the plug and located within the internal cavity comprising a speaker, a signal generator, a power source, and a motion detection switch.

2. The hoop toy of claim 1 wherein the pitch of the sound produced by the sound generating means is adjustable.

3. The hoop toy of claim 1 wherein the sound generating means produces a beat and the rate of the beat is adjustable.

4. The hoop toy of claim 1 wherein the sound generating means produces a tune and the speed at which the tune is produced is adjustable.

5. The hoop toy of claim 1 wherein the pitch of the sound produced by the sound generating means is a function of the rate of opening and/or closing of the motion detection switch.

6. The hoop toy of claim 1 wherein the sound generating means produces a beat and the rate of the beat is a function of the rate of opening and/or closing of the motion detection switch.

7. The hoop toy of claim 1 wherein the sound generating means produces a tune and the speed at which the tune is generated is a function of the rate of opening and/or closing of the motion detection switch.

* * * * *